US005197908A

United States Patent [19]

Nelson

[11] Patent Number: 5,197,908

[45] Date of Patent: Mar. 30, 1993

[54] CONNECTOR

[76] Inventor: Gunnar Nelson, P.O. Box 32817, Palm Beach Gardens, Fla. 33420

[21] Appl. No.: 800,092

[22] Filed: Nov. 29, 1991

[51] Int. Cl.[5] ..... H01R 13/00

[52] U.S. Cl. ..... 439/825; 439/839

[58] Field of Search ..... 439/825, 839, 851, 852, 439/853, 854, 855, 856, 857, 861, 862

[56] References Cited

U.S. PATENT DOCUMENTS 2,596,712 8/1951 Frei et al. ..... 439/851
2,780,792 2/1957 Earl ..... 439/825
2,930,023 3/1960 Earl ..... 439/825
3,316,528 4/1967 Juris et al. ..... 439/839
3,789,346 1/1974 Brick ..... 439/825
3,924,922 12/1975 Decenzo ..... 439/839
4,012,105 3/1977 Biddle ..... 439/854

*Primary Examiner*—Joseph H. McGlynn
*Attorney, Agent, or Firm*—Thomas L. Adams

[57] ABSTRACT

A connector pair has a receptacle and a plug. The receptacle has a sleeve with an outer mouth. The sleeve converges towards its outer mouth. The plug has a prong with a graded tip. This prong diverges towards the tip. The prong is sized to fit snugly inside the sleeve. Thus, the outside of the prong can make intimate electrical contact with the inside of said sleeve.

23 Claims, 2 Drawing Sheets

CONNECTOR

BACKGROUND OF THE INVENTION

The present invention relates to connectors, and in particular, to a plug and receptacle having at least one mating surface that either converges or diverges.

Connectors for handling substantial amounts of power or current must be designed to make a firm and stable contact to avoid heating that would increase the risk of fire or premature failure.

A known connector pair shown in FIG. 1 has a solid cylindrical prong 10. The back end of the male plug has a cup-shaped terminal 12 with a screw fastener 14 for holding in place a wire 16. A female receptacle 18 has a conical sleeve 20, which is slit to provide a number of petals. These petals diverge inwardly to provide a contact point essentially at the mouth 22 of sleeve 20. The rear of the female receptacle 18 has a socket 24 for holding a wire 26 in place with screw fastener 28. An example of a connector pair of this type is shown in U.S. Pat. No. 4,797,126.

A disadvantage with this type of connector pair is the limited contact surface at mouth 22. Since current must flow at this narrowly defined region, current density becomes quite high, encouraging heating and early failure. Additionally, the narrow region of contact allows prong 10 to rock in the receptacle 18. Also, the arrangement of the screw fasteners restricts the strength of the connection between the wires 16 and 26 to the connector pair.

A known "RCA" plug is shown U.S. Pat. No. 4,789,355. The prong in this plug is split lengthwise, but the two halves of the prong remain parallel and still have the disadvantages described above, that is, a limited contact area and a tendency to rock.

Known banana plugs employ a slender cylindrical shell with spaced, lengthwise slits defining the edges of arching strips that run lengthwise on the plug. This structure is relatively thin and inappropriate for handling high currents. Another disadvantage with a plug of this type is that the arched strips have a peak, which again narrowly limits the contact point to the peak. Because of this limited contact surface, the heating, unreliability and rocking problems discussed above still exist.

In U.S. Pat. No. 4,735,588, a split male plug has a pair of prongs that arch outwardly at their center. These prongs are inserted into a female cavity, whose cross section is constant. Again, the contact surface is limited with the consequential disadvantages noted above. See also U.S. Pat. No. 4,464,009.

Accordingly, there is a need for an improved connector pair that can handle relatively high currents and power levels, with a simple, reliable structure that provides a relatively broad contact area.

SUMMARY OF THE INVENTION

In accordance with the illustrative embodiments demonstrating features and advantages of the present invention, there is provided a connector pair having a receptacle and a plug. The receptacle has a sleeve with an outer mouth. This sleeve converges towards the outer mouth. The plug has a prong with a graded tip. This prong diverges towards the tip. The prong is sized to fit snugly inside the sleeve. Thus the outside of the prong can make intimate electrical contact with the inside of the sleeve.

By employing such apparatus, a relatively simple and effective connector pair is achieved. In a preferred embodiment, the plug has a split prong, which diverges towards its rounded tip. The matching female receptacle has a sleeve also divided into a number of cylindrical petals that converge inwardly towards its mouth. The angles of convergence and divergence need not be great and can be, for example, less than 5 degrees.

In this preferred embodiment, the prong of the plug may be rounded or otherwise tapered for easy insertion into the mouth of the receptacle. In this preferred embodiment, the prong will compress and the mouth of the receptacle will expand when thrust together. The expansion of the receptacle can be regulated by a metal band slipped around the petals of the receptacle sleeve, near its mouth.

With structure of this type, the outside surface of the prong can be at about the same angle as the inside surface of the receptacle sleeve. Thus, the pair makes contact over a relatively broad surface. This feature reduces current density and increases reliability. In this preferred embodiment, the receptacle and the plug each have socket-type, rear terminals for connecting to a wire. Preferably, a pair of set screws can be employed to provide a highly reliable connection to the wire. In this preferred embodiment, the plugs and receptacles can be arranged in a spaced pattern inside an appropriate housing or casing.

BRIEF DESCRIPTION OF THE DRAWINGS

The above brief description as well as other objects, features and advantages of the present invention can be more fully appreciated by reference to the following detailed description of presently preferred but nonetheless illustrative embodiments in accordance with the present invention when taken in conjunction with the accompanying wherein.

DETAILED DESCRIPTION OF THE PREFERRED EMBODIMENTS

Figure 1:
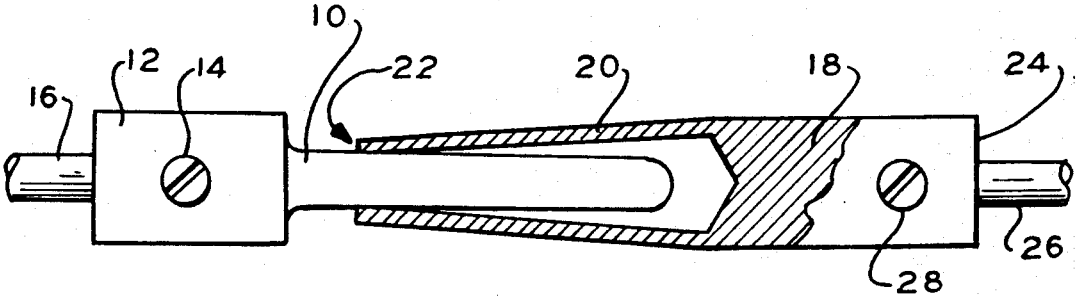
FIG. 1 PRIOR ART
FIG. 1 is a side view, partially in section, of a connector pair, according to the prior art.
Figure 2:
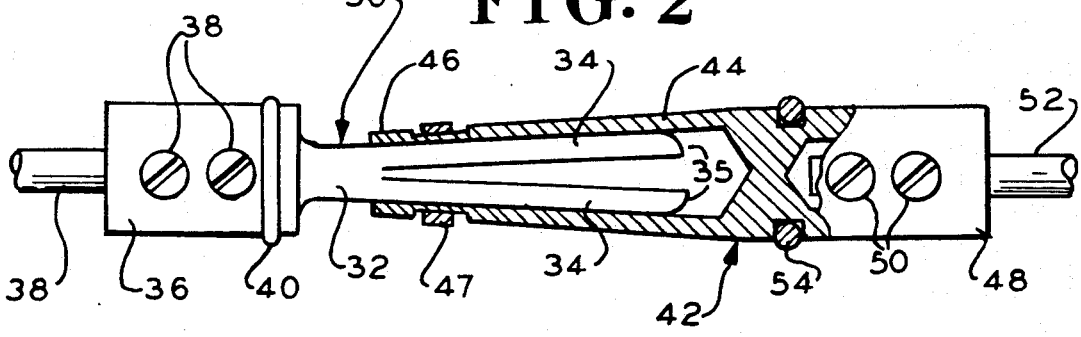
FIG. 2 is a side view of a connector pair, partially in section and with some of its dimensions exaggerated for illustrative purposes, in accordance with the principles of the present invention.

Referring to FIG. 2, plug 30 is shown employing a cylindrical prong base 32, which is integral with a prong comprising a pair of semi-cylindrical tines 34. Tines 34 are shown diverging at an exaggerated angle, while in practical embodiments the angle of divergence may be somewhat less than 5 degrees. Prong tines 34 have a graded tip 35, which is in this embodiment a rounded or blunted tip. Plug 30 may be a machined or molded brass alloy appropriate for an electrical connector.

Integral to the rear of base 32 is a cup-shaped terminal 36. Duplex, threaded fasteners are shown herein as set screws 38, although other types of connections can be made. Terminal 36 is a hollow cylinder having an open end to receive a wire 38. The hollow of terminal 36 may be eccentric to provide more material around the apertures holding screws 38. The increased material enhances the holding strength of the fasteners threaded into these apertures. The outside of terminal 36 has an annular groove containing 0 ring 40, which enables mounting in the water tight casing illustrated hereinafter.

Plug 30 is shown mated to receptacle 42 comprising sleeve 44 having a generally frustro-conical shape. Sleeve 44 converges towards outer mouth 46. While exaggerated in this view, in practical embodiments, the angle of convergence of sleeve 44 will be somewhat less than 5 degrees.

The rear of receptacle 42 is formed into a cup-shaped, wire socket 48 having a shape similar to that of terminal 36. As before, socket 48 has a pair of threaded fasteners, shown herein as a pair of set screws 50 for securely holding wire 52. Also, the hollow of socket 48 may again be eccentric to provide more material around the apertures holding screws 50. Receptacle 42 has an annular groove containing O ring 54 for water tight mounting to a housing illustrated hereinafter. Also mounted in an annular recess near mouth 46 is split spring steel metal band 47 that tends to compress the petals of sleeve 44. Receptacle 42 can be made of materials and be manufactured by a process similar to that of plug 30.

Figure 3:
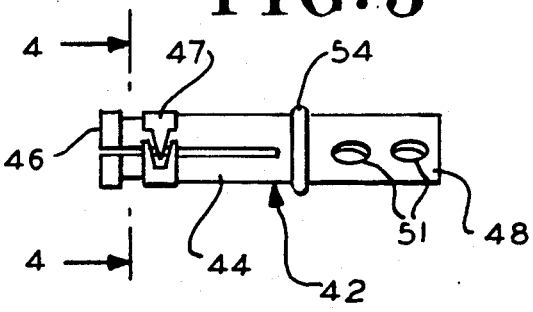
FIG. 3 is side view of a receptacle similar to that of FIG. 2, but without the exaggeration.
Figure 4:
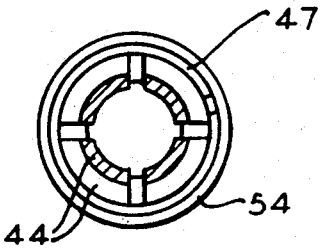
FIG. 4 is a cross sectional view taken along line 4—4 of FIG. 3.

Referring to FIGS. 3 and 4, the previously mentioned receptacle is shown again, but without certain dimensions exaggerated. The set screws in wire socket 48 are removed to reveal threaded bores 51. As illustrated, the petals segments of sleeve 44 converge towards mouth 46, but at a relatively small angle, somewhat less than 5°, suitably 1° to 2°.

In some embodiments, the convergence of sleeve 44 may be such that their inside surfaces curve slightly in a longitudinal direction. For example, the spacing of the petals of sleeve 44 may be established by crimping band 47 at mouth 46. Such a technique does not necessarily result in a linear deformation.

Sleeve 44 is composed of four petal segments, although in other embodiments more or fewer segments can be employed. Band 47 is further shown as a spring steel ring, which is split to form a gap having a tongue and groove joint. This gap allows band 47 to expand when the petal segments of sleeve 44 expand.

The overall length of receptacle 42 in the disclosed embodiment. is about 2 inches. Sleeve 44 is about 1⅛ inches long. The outside diameter of wire socket 48 is about ⅜ inch. Mouth 46 has a shoulder which brings its outside diameter to about ⅜ inch, notwithstanding the convergence of sleeve 44. The opening at mouth 46 is about ¼ inch. It will be appreciated, however, that these dimensions can be changed significantly, depending upon the rated current, voltage, power and other ratings, as well as the desired structural integrity and strength.

Figure 5:
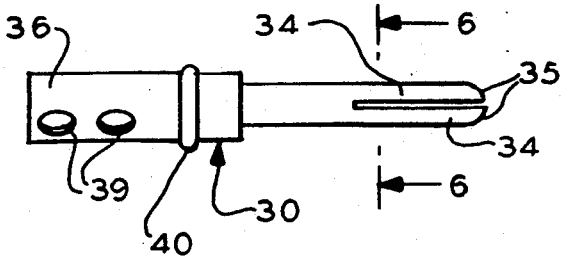
FIG. 5 is side, view of a plug similar to that of FIG. 2, but without the exaggeration.
Figure 6:
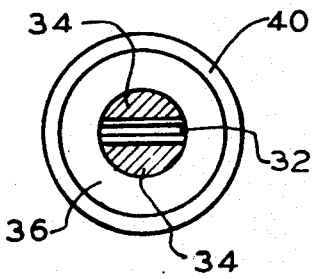
FIG. 6 is a cross sectional view taken along line 6—6 of FIG. 4.

Referring to FIGS. 5 and 6, previously mentioned plug 30 is shown, but without dimensions exaggerated as before. The set screws are removed from terminal 36 to reveal a pair of axially spaced, threaded apertures 39. The change in the spacing between tines 34 does not change dramatically and the angle between the inside surfaces of the tines is somewhat less than 5°, suitably 1° to 2°.

In some embodiments, the divergence of tines 34 may be such that their inside surfaces are slightly curved. For example, the spacing of tines 34 may be established by pressing a relatively thin wedge between them. Such a technique does not necessarily result in a straight tine.

The overall length of plug 30 is about 2⅝ inches, and terminal 36 is about 1¼ inches long. The tines 34 are about one inch long. The diameter of base 32 is about ¼ inch. The outside diameter of terminal 36 is about ⅛ inch. It will be appreciated, however, that these dimensions can be changed significantly, depending upon the rated current, voltage, power and other ratings, as well as the desired structural integrity and strength.

Figure 7:
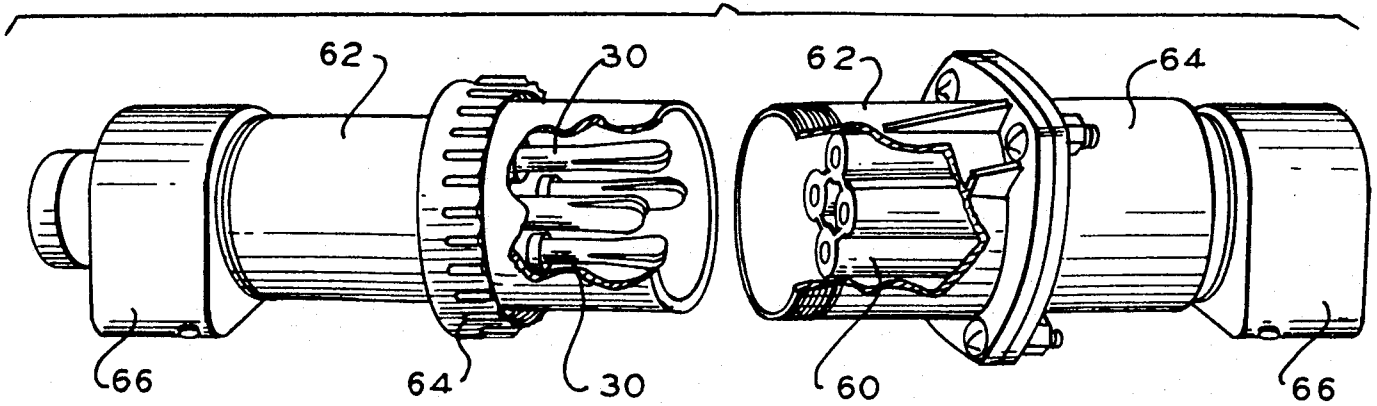
FIG. 7 is a perspective view of a connector pair, with portions broken away for illustrative purposes, employing a number of the receptacles and plugs of FIGS. 3 and 5.
Figure 9:
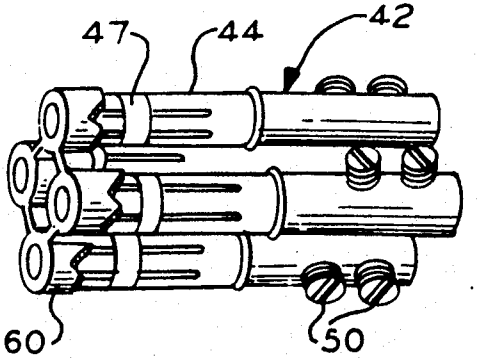
FIG. 9 is a perspective view of the receptacles and frame of FIG. 7, but with the outer housing removed and a portion of the frame broken away for illustrative purposes.
Figure 8:
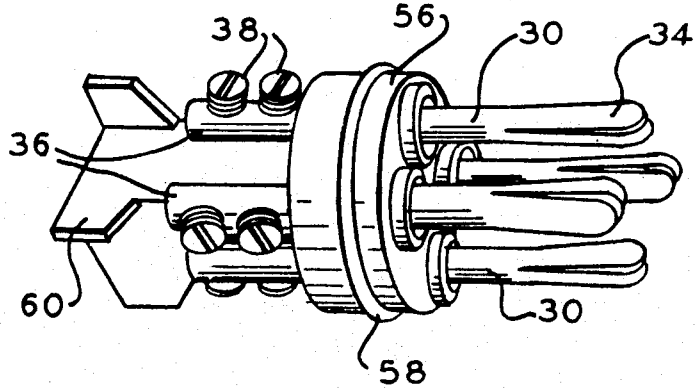
FIG. 8 is a perspective view of the plugs and body of FIG. 7, but with the outer casing removed for illustrative purposes.

Referring to FIGS. 7, 8 and 9, four of the previously mentioned plugs 30 are shown mounted in a body 56 shaped as a cylindrical barrel with four holes for holding plugs 30. While plugs 30 are shown identical here, in some embodiments one can be larger to polarize the plug, allowing only one orientation to work. Alternatively, one plug designed to carry low current (for example, a ground connection) can be larger and solid to polarize the plug. Barrel 56 has an O ring 58 mounted in an annular groove to form watertight seal between the casing and barrel. The rear of barrel 56 has a plurality of ribs 60 for providing rear support to barrel 56 and also providing insulated barriers between plugs. Barrel 56 is mounted inside casing 62, which is encircled by a threaded collar 64 and capped by a locking nut 66.

Four collars 60 are integrally molded into a housing 62. Four of the previously mentioned receptacles 42 are separately mounted inside collars 60. Housing 62 is bolted to a rear cover 64 capped by a locking nut 66. The forward end of housing 62 is externally threaded to mate with the internal threads of threaded collar 64.

To facilitate an understanding of the principles associated with the foregoing apparatus, its operation will now be briefly described. The connector pair may be assembled as shown in FIG. 7. Wires 52 and 38 (FIG. 2) can be secured by fastening set screws 38 and 50 in the usual fashion. If polarized with a larger plug, the connector pair can be oriented so that the larger plug 30 is aligned with a correspondingly larger receptacle 42. Thus oriented, the assemblies can be thrust together and then locked in placed using threaded collar 64.

When each of the plugs 30 mate with receptacles 42, graded tip 35 (FIG. 2) is thrust against the mouth 46 of receptacle 42. Because tip 35 is graded, it acts as a wedge to both expand sleeve 44 and compress tines 34. Consequently, plug 30 can be inserted inside receptacle 42 as shown in FIG. 2.

Although, the angles of convergence and divergence are somewhat exaggerated in FIG. 2, this Figure shows tines 34 diverging at about the same angle as the angle of convergence of sleeve 44. Consequently, there is a large area of surface contact between plug 30 and receptacle 42. This large area reduces current density and the tendency to overheat. Also, the large area of surface contact reduces the tendency of plug 30 to rock inside receptacle 42. Consequently, the connector pair operates cooler, more reliably and with less play and a reduced fire risk.

When the plug 30 is withdrawn, the process reverses in that the tines 34 compress and sleeve 44 expands to allow disconnection.

It is to be appreciated that various modifications may be implemented with respect to the above described and presently preferred embodiments. For example, the various dimensions can be altered depending upon the rating of the connector. Also, while many of the plug and receptacle components are cylindrical, in some embodiments, the cross sections may have rectangular, polygonal or other shapes including shapes that polarize the plug. Also, the angle of convergence and divergence of the connector pair can be altered depending on the desired interlocking strength and the desired flexibility of the components. Additionally, the contact surfaces can be plated with noble metals or other materials to provide a reliable electrical contact. While the illustrated connector is waterproof, it need not necessarily be so. Furthermore, the metal band used to reinforce the compression of the receptacle sleeve can be an unsplit annulus formed of various materials including elastomeric or plastic materials. Also, the manner of connecting a wire to the plug and receptacle can be altered, and in some embodiments a flat headed screw may be used with a spade or lug, as well as other varieties of known wire connectors. While the prong of the plug is split in two and the sleeve of the receptacle is divided into four petals, in other embodiments a different number of segments may be employed. Also, the housing or casing employed to hold a group of plugs or receptacles can have various shapes, keying, thicknesses etc., depending upon the application.

Obviously many modifications and variations of the present invention are possible in light of the above teachings. It is therefore to be understood that within the scope of the appended claims, the invention may be practiced otherwise than as specifically described.

I claim:

1. A connector pair comprising:

a receptacle having a sleeve with an outer mouth, said sleeve converging towards its outer mouth; and a plug comprising a prong having a longitudinal axis and terminating in a graded tip, said prong diverging towards said tip and being sized to fit snugly inside said sleeve for preventing angular displacement of said axis of said prong, said prong further having a base and pair of tines cantilevered from said base, said pair of tines partially dividing said prong lengthwise, said pair of tines both diverging and touching the inside of said sleeve along a length from the junction of said base and said tines up to said graded tip, so that the outside of said tines can make intimate electrical contact with the inside of said sleeve.

2. A connector according to claim 1 wherein said sleeve is at least partially divided lengthwise.

3. A connector according to claim 1 wherein said tip is compressible.

4. A connector according to claim 3 wherein said sleeve is at least partially divided lengthwise.

5. A connector according to claim 4 wherein said prong is compressible.

6. A connector according to claim 5 wherein said sleeve is expandable.

7. A connector according to claim 6 wherein said plug has a cup-shaped terminal and wherein said prong is integral to and coaxial with said terminal, said prong having a cylindrical base and a pair of semi-cylindrical tines cantilevered from said base.

8. A connector according to claim 7 wherein said receptacle has a cup-shaped, wire socket integral with said sleeve, said receptacle having a resilient, split band encompassing said sleeve proximal its mouth.

9. A connector according to claim 8 wherein said wire socket and said terminal each have a pair of threaded fasteners adapted to hold wire.

10. A connector according to claim 8 wherein said wire socket and said terminal each have a pair of threaded fasteners adapted to hold wire.

11. A connector according to claim 1 wherein said prong diverges at an angle less than 2° towards said graded tip.

12. A connector according to claim 11 wherein said sleeve converges at an angle less than 2° towards said outer mouth.

13. A connector pair comprising:

a frame;

a plurality of receptacles mounted on said frame and each having a sleeve with an outer mouth, said sleeve converging towards its outer mouth;

a body; and a plurality of plugs mounted on said body and each comprising a prong having a longitudinal axis and terminating in a graded tip, said prong diverging towards said tip and being sized to fit snugly inside said sleeve for preventing the angular displacement of said axis of said prong, said prong further having a base and a pair of tines cantilevered from said base, said pair of tines partially dividing said prong lengthwise, said pair of tines both diverging and touching the inside of said sleeve along a length from the junction of said base and said pair of tines up to said graded tip, so that the outside of said pair of tines can make intimate electrical contact with the inside of said sleeve.

14. A connector according to claim 13 wherein said frame includes a threaded housing and wherein said body includes a casing, said housing and said casing being threadably interconnectable.

15. A connector according to claim 13 wherein said sleeve is at least partially divided lengthwise.

16. A connector according to claim 13 wherein said tip is compressible.

17. A connector according to claim 16 wherein said sleeve is at least partially divided lengthwise.

18. A connector according to claim 17 wherein said prong is compressible.

19. A connector according to claim 18 wherein said sleeve is expandable.

20. A connector according to claim 19 wherein said plug has a cup-shaped terminal and wherein said prong is integral to and coaxial with said terminal, said prong having a cylindrical base and a pair of semicylindrical tines projecting from said base, said receptacle having a cup-shaped, wire socket integral with said sleeve, said receptacle having a resilient, split band encompassing said sleeve proximal its mouth.

21. A connector according to claim 13 wherein said prong diverges at an angle less than 2°.

22. A connector according to claim 21 wherein said prong diverges at an angle less than 2°.

23. A connector pair comprising:

a frame having a threaded housing;

a plurality of receptacles mounted on said frame and each including:

(a) an expandable sleeve with an outer mouth, said sleeve converging towards its outer mouth at an angle of less than 2°, said sleeve being at least partially divided lengthwise, (b) a cup-shaped, wire socket integral with said sleeve, said wire socket having a pair of threaded fasteners adapted to hold wire, and (c) a resilient, split band encompassing said sleeve proximal its mouth;

a body; and a plurality of plugs mounted on said body and each including:

(a) a prong with a graded tip, said prong and its tip being compressible, said prong diverging towards said tip at an angle less than 2°, said prong being at least partially divided lengthwise, said prong being sized to fit snugly inside said sleeve for preventing angular displacement of said axis of said prong, so that the outside of said prong can make intimate electrical contact with the inside of said sleeve, said prong including (i) a cylindrical base, and (ii) a pair of semi-cylindrical tines cantilevered from said base, said pair of tines both diverging and touching the inside of said sleeve along a length from the junction of said base and said pair of tines up to said graded tip, and (b) a cup-shaped terminal integral to and coaxial with said prong, said terminal having a pair of threaded fasteners adapted to hold wire; and a casing supporting said body and said plugs, said housing and said casing being threadably interconnectable.

* * * * *